United States Patent [19]

Monaco

[11] Patent Number: 4,477,076

[45] Date of Patent: Oct. 16, 1984

[54] DEFENSIVE REACTION FOOTBALL BLOCKING DEVICE

[76] Inventor: Robin Monaco, 97 Fans Rock Rd., Hamden, Conn. 06518

[21] Appl. No.: 254,957

[22] Filed: Apr. 16, 1981

[51] Int. Cl.[3] ..... A63B 69/00

[52] U.S. Cl. ..... 273/55 R

[58] Field of Search ..... 434/251; 273/55 R, 55 A

[56] References Cited

U.S. PATENT DOCUMENTS

| | | | |
|---|---|---|---|
| 2,653,816 | 9/1953 | Young et al. | 273/55 R |
| 3,044,776 | 7/1962 | Weidmaier et al. | 273/55 R |
| 3,062,547 | 11/1962 | Kopp | 273/55 R |
| 3,144,251 | 8/1964 | Gainey et al. | 273/55 R |
| 3,237,944 | 3/1966 | Kopp | 273/55 R |
| 3,329,428 | 7/1967 | Moran | 273/55 R |
| 3,365,947 | 1/1968 | Janich et al. | 273/55 R X |
| 3,425,692 | 2/1969 | Leach | 273/55 R |
| 3,427,021 | 2/1969 | Donato | 273/55 R X |
| 3,514,105 | 5/1970 | Pillard | 273/55 R |
| 3,578,324 | 5/1971 | Alvey et al. | 273/55 R |
| 3,674,265 | 7/1972 | Sheets et al. | 273/55 R |
| 3,684,283 | 8/1972 | Forrest | 273/55 R |
| 3,820,365 | 6/1974 | Silva | 172/8 |
| 3,825,260 | 7/1974 | Thomas, Sr. | 273/55 R |
| 3,827,690 | 8/1974 | Rogers | 273/55 R |
| 3,873,089 | 3/1975 | Krug | 273/55 R |
| 3,889,949 | 6/1975 | Gardner | 273/55 R |
| 3,897,060 | 7/1975 | Jennings | 273/55 R |
| 4,087,089 | 5/1978 | Forrest | 273/55 R |

*Primary Examiner*—William H. Grieb

*Attorney, Agent, or Firm*—Stephen A. Litchfield; Carmen B. Patti

[57] ABSTRACT

A football blocking device for training defensive linemen to react to the snap of a football and to charging offensive linemen, wherein the device comprises at least one blocking dummy and a ball object positioned adjacent the blocking dummy. The ball object is moveable rearwardly and the blocking dummy is moveable from a set position forwardly and downwardly to a blocking position to thereby simultaneously simulate the snap of a football and the charge of an offensive lineman. The device optionally includes a mechanism for turning the blocking dummy while it moves forwardly and downwardly to simulate a charging offensive lineman who is also turning.

23 Claims, 11 Drawing Figures

38
36a
80a
36b
80b
38b
34b
38a
34a
108
36c
80c
38c
34c
138
133
130
104
142
102
140
128
129
136
106
16
150
95
94
152
12
18
10
153
34b
34a

DEFENSIVE REACTION FOOTBALL BLOCKING DEVICE

BACKGROUND OF THE INVENTION

The present invention relates to football blocking devices, and, more particularly, the present invention relates to a football blocking device for training defensive linemen to react to the snap of a football and to charging offensive linemen.

In the training of a defensive lineman for football, it is desirable to subject the lineman to simulated game conditions. Under actual game conditions, the defensive lineman lines up opposite the offensive linemen. When the center snaps the football, the offensive lineman charges forward and attempts to keep his center of gravity low in order to be most effective in blocking the defensive lineman. If the defensive lineman charges before the ball is snapped, his team is penalized. If he delays charging until after the snap, the defensive lineman is likely to be caught off guard by the offensive lineman. Thus, it is essential for the defensive lineman to coordinate his charge with the snap of the football.

Football training devices which simulate the charge of a lineman are known. One such device is disclosed in U.S. Pat. No. 3,329,428 which was issued July 4, 1967 to J. A. Moran. This football blocking device utilizes a blocking dummy mounted on the end of a plunger which is driven forward by the force of a large compressed spring. One disadvantage of this device is that it may be dangerous in that a lineman who is caught off guard may be injured by the forward thrust of the plunger. Also, once the forward thrust is complete, the device disclosed in this patent does not simulate the resistance an opposing offensive lineman would give to a defensive lineman.

Another football blocking device is disclosed in U.S. Pat. No. 3,674,265 issued July 4, 1972 to Sheets and Booth. This patent discloses a football blocking device wherein a compressed spring drives a plunger having a blocking dummy mounted thereon forward to simulate the initial charge of lineman. The plunger includes a compression spring on the forward end thereof to simulate the lineman's shock-rebound properties. The angle of the plunger stroke and the force of the springs can be varied to simulate different charges and retreats. The device also includes a football snap simulating mechanism actuated simultaneously with the forward movement of the plunger. This device, as does the device described in U.S. Pat. No. 3,329,428 to Moran, includes a plunger that moves forwardly under the force of a compressed spring and has the same disadvantage that injuries may result to a lineman caught off guard. Moreover, the mechanism for moving the blocking dummy forward simultaneously with the rearward movement of a ball object is relatively complex and expensive to manufacture. Furthermore, after each actuation of the device, the spring which drives the plunger forward must be compressed again, thus requiring a relatively strong coach and delaying the next drill. Moreover, in a device including three or more blocking dummies, the spring associated with each of the plungers must be compressed after each actuation and this may result in delays during practice.

U.S. Pat. No. 3,044,776 issued on July 17, 1962 to Weidmaier and Nicolino discloses a football training device wherein a blocking dummy is moved forwardly by hand operation and a simulated football object is moved rearwardly by foot operation. This device is relatively complicated and may not necessarily provide for simultaneous forward movement of the blocking dummy and rearward movement of the ball.

Other football blocking devices are disclosed in the following U.S. Pat. Nos.: 2,653,816; 3,062,547; 3,144,251; 3,237,944; 3,365,947; 3,425,692; 3,427,021; 3,514,105; 3,578,324; 3,684,283; 3,825,260; 3,827,690; 3,873,089; 3,889,949; 3,897,060; and 4,087,089.

SUMMARY OF THE INVENTION

A football blocking device in accordance with the present invention trains defensive linemen to react to the snap of a football and to charging offensive linemen. The football blocking device comprises a base for supporting the various components of the blocking device. The device includes at least one blocking dummy, each blocking dummy being mounted on an end portion of an elongate ram. A ball object is positioned adjacent the blocking dummy and is mounted on the end portion of an elongate rod. The device includes at least one, and preferably two lever members, each lever member having an upper end and a lower end and being pivotally mounted on said base about an axis fixed relative thereto. The upper end of each lever is connected pivotally with the ram and the lower end of each lever is connected pivotally with the rod.

To actuate the device, the coach pushes the elongate ram forwardly to pivot the lever members, which are preferably initially in a vertical position, to thereby move the ball object rearwardly and to simultaneously move the blocking dummy forwardly and downwardly from a set position to a blocking position. This simultaneous movement of the blocking dummy and the ball simulates the snap of a football and the charge of an offensive lineman. The lever members are restrained from further forward pivoting movement by a stop mechanism.

It is intended that the blocking dummy move from its set position to its blocking position before the defensive lineman has an opportunity to charge and contact the blocking dummy thereby avoiding possible injury to the defensive lineman. Also, since the force of the forward and downward movement of the blocking dummy is relatively slight in comparison to prior art devices wherein the dummy is forced forward by a compressed spring, there is little risk of injury to the defensive lineman even if the blocking dummy is contacted prior to reaching the blocking position.

Once the blocking dummy is moved to the blocking position, the defensive lineman charges and contacts the blocking dummy. In accordance with one aspect of the invention, the football blocking device includes a mechanism for biasing the elongate ram forwardly to simulate the resistance of an offensive lineman. The elongate ram is depressed rearwardly against the biasing means, which may be for example, a spring, without pivoting the lever members rearward.

In accordance with another aspect of the invention, for each lever member, the distance between the lever member pivot point and the point of pivotal connection between the upper end of the lever member and the ram is relatively short, and the angle of the lever member with respect to the vertical is preferably greater than 45 degrees when the device is in the blocking position, so that the charging lineman's force, which may be quite large, is exerted on the lever member at an angle and at a short distance from the lever pivot point such that a relatively small reverse moment is exerted on the lever member. If the angle between the vertical position and the blocking position of the lever members is increased, the resistance of the lever members to pivot in a reverse direction is increased. The blocking dummy is mounted eccentrically downwardly with respect to the ram so that when the center of the dummy is contacted by the charging lineman, a downward moment about the point of pivotal connection between upper end of the lever member and the ram is exerted on the ram to urge it downwardly and to help maintain it in the blocking position. The blocking dummy in the blocking position is relatively near to the ground so that it is difficult for the advancing lineman to get under the dummy and push it upwardly. Thus, the advancing lineman imposes a force on the blocking dummy that has a substantial rearward component but very small or no upward component. Through a combination of the foregoing factors, for all practical purposes, the lineman will not be able to force the ram and the dummy upwardly and rearwardly.

In accordance with another aspect of the invention, each blocking dummy includes a simulated head object located at the upper region thereof and the football blocking device further includes a mechanism for rotating the blocking dummy to simulate the turning of an offensive lineman. This allows the coach to vary the apparent angle of attack of the offensive lineman and teaches the defensive lineman to react quickly to a turning offensive lineman.

In accordance with another aspect of the invention, the ball object is biased forwardly by a spring mechanism and may be depressed rearwardly against the spring mechanism upon imposition of a rearward force on the ball object by a charging defensive lineman. Thus, should the defensive lineman inadvertently strike the ball, the ball will retract and the lineman will not be injured.

In accordance with another aspect of the invention, the football blocking device may include more than one blocking dummy, each mounted on its respective elongate ram. The plurality of blocking dummies are arranged for simultaneous forward and downward movement to simulate several charging offensive linemen. Each elongate ram has a separate biasing means for absorbing the impact of the defensive linemen so that the different strengths of linemen may be accommodated. Further, a device in accordance with the present invention allows for the simultaneous resetting of all of the blocking dummies. More particularly, by pivoting the levers back to the vertical position, all of the blocking dummies are reset and ready for another training drill.

A football blocking device in accordance with the present invention has several advantages not heretofore found in the prior art football blocking devices. The football blocking device avoids injury to linemen by avoiding a spring loaded forward movement of the blocking dummy. The blocking device of the present invention is relatively simple to construct in that the actuation of the dummy and the ball is provided by two lever members which pivot from a vertical position forwardly to a blocking position. A further advantage of the blocking device in accordance with the present invention is that the device not only simulates a charging offensive lineman, but also simulates the turning of the charging offensive lineman. Additional advantages of a blocking device in accordance with the present invention will be apparent from the detailed description of the invention with reference to the drawings.

DESCRIPTION OF THE PREFERRED EMBODIMENTS

Figure 1:
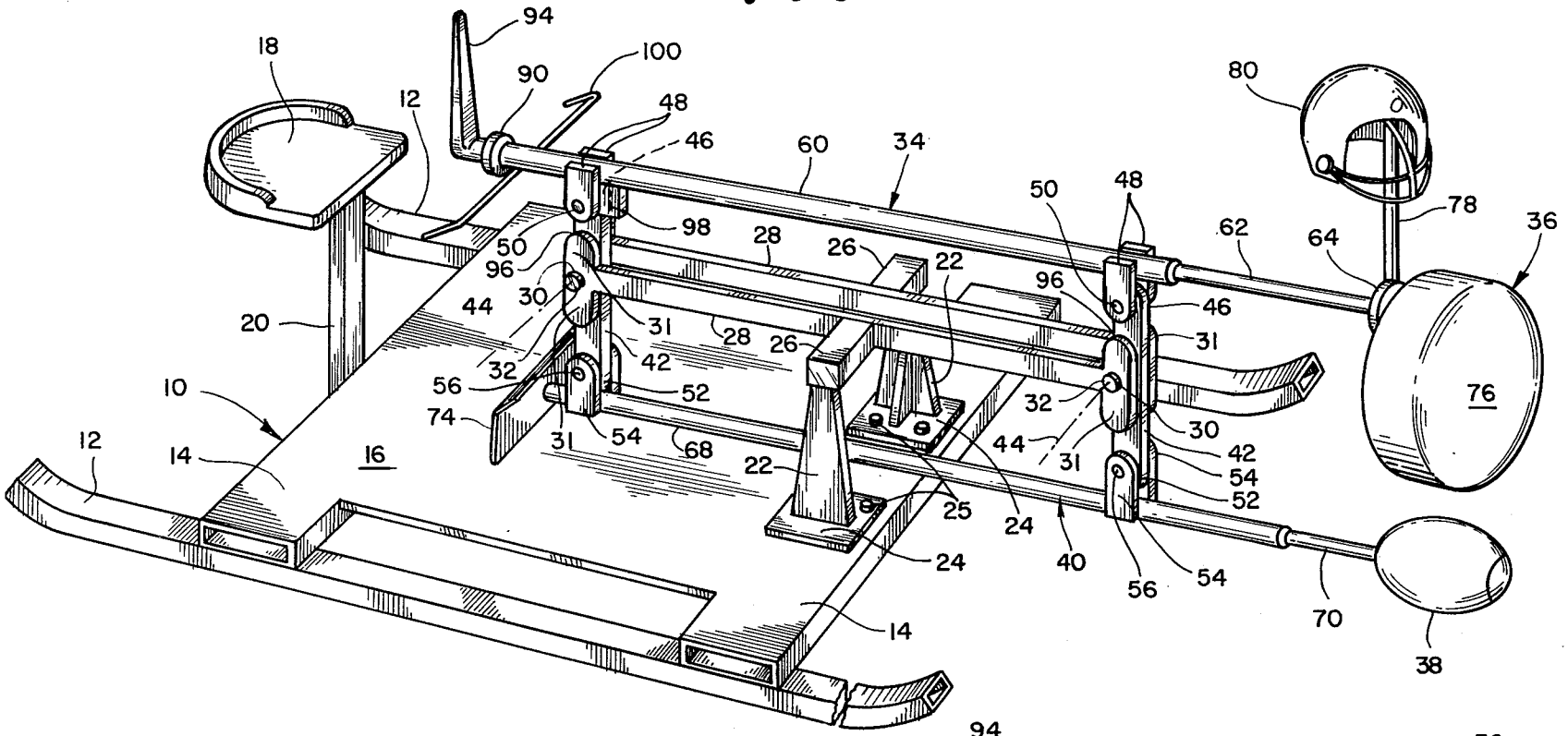
FIG. 1 is a perspective view of a blocking device in accordance with the present invention wherein the blocking device includes a single blocking dummy.

Referring to FIGS. 1–6, a football device in accordance with the present invention includes a base 10 for supporting the various components of the blocking device. The base is made from materials having sufficient rigidity to support the components of the football blocking device. In the device shown in FIGS. 1–6, the base comprises two elongate rectangular tubular rails 12 extending in parallel relation. Attached to rail 12, as by welding, are two elongate tubular members 14 extending therebetween. A sheet metal platform 16 is attached to the tubular members 14. A seat 18 is attached at one end of the platform 16 via a tubular segment 20. Seat 18 is for a coach who operates the football blocking device and observes the training of the linemen.

The supporting base 10 further includes two vertical supporting legs 22 having feet 24 affixed to support plate 16, for example, by bolts 25. Legs 22 have their upper ends 26 rigidly connected with parallel support arms 28 having apertures 30 on the ends thereof receiving pins 32. The structure of support base 10 which has been described above is rigid and functions to locate pivot pins 32 about which the moving components of the football blocking device operate. It should be understood that other supporting structures may be used that provide a locus for pivot pins 32.

The football blocking device includes an elongate ram 34 having a blocking dummy 36 mounted on an end portion thereof. A ball object 38, which may be any visual means on which a defensive lineman can focus to sense simulated ball movement, is positioned adjacent the blocking dummy 36 so that the dummy and the ball object simulate a football center in the set position about to snap the football. The ball object is mounted on an end portion of an elongate rod 40. The moveable support for ram 34 and rod 40 will now be described.

The block device includes at least one, and preferably two pivotal lever members 42 that guide the movement of ram 34 and rod 40, which, as will be described below, in turn move the ball object 38 rearwardly to simulate the snap of a football and blocking dummy 36 from a set position forwardly and downwardly to a blocking position to simulate a charging offensive lineman. Levers 42 are pivotally mounted intermediate their ends on pins 32 to provide for pivotal movement of levers 42 about a pair of axes 44 (see FIG. 1 and FIG. 3A) fixed relatively to base 10 and parallel to platform 16. The upper ends 46 of each lever members 42 are pivotally mounted with respect to elongate ram 34 by any suitable means, such as, for example, a pair of depending support brackets 48 welded to opposite sides of ram 34, each lever 42 being pivoted to a pin 50 through both brackets 48 and the end 46 of the lever. The lower ends 52 of each lever 42 are similarly pivotally mounted with respect to elongate rod 40 which has ball object 38 mounted thereon. In this instance, the support brackets 54, which correspond to ram support brackets 48, extend upward and are welded to opposite sides of rod 40, with a pin 56 extending through both brackets 54 and the lower end 52 of each lever 42.

Figure 3A:
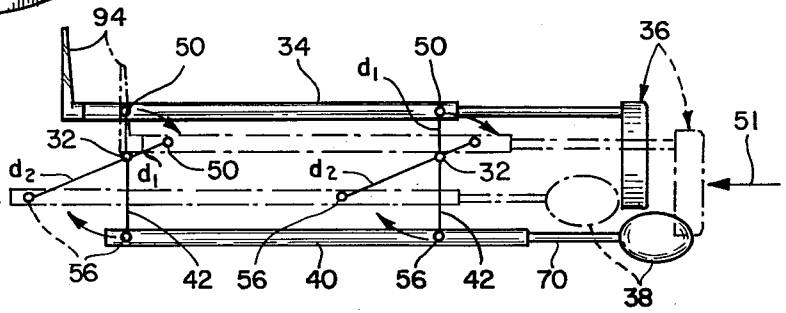
FIG. 3A is a schematic side view of the device shown in FIG. 3 wherein the device is shown in the set position in solid lines and in the blocking position in phantom.
Figure 2:
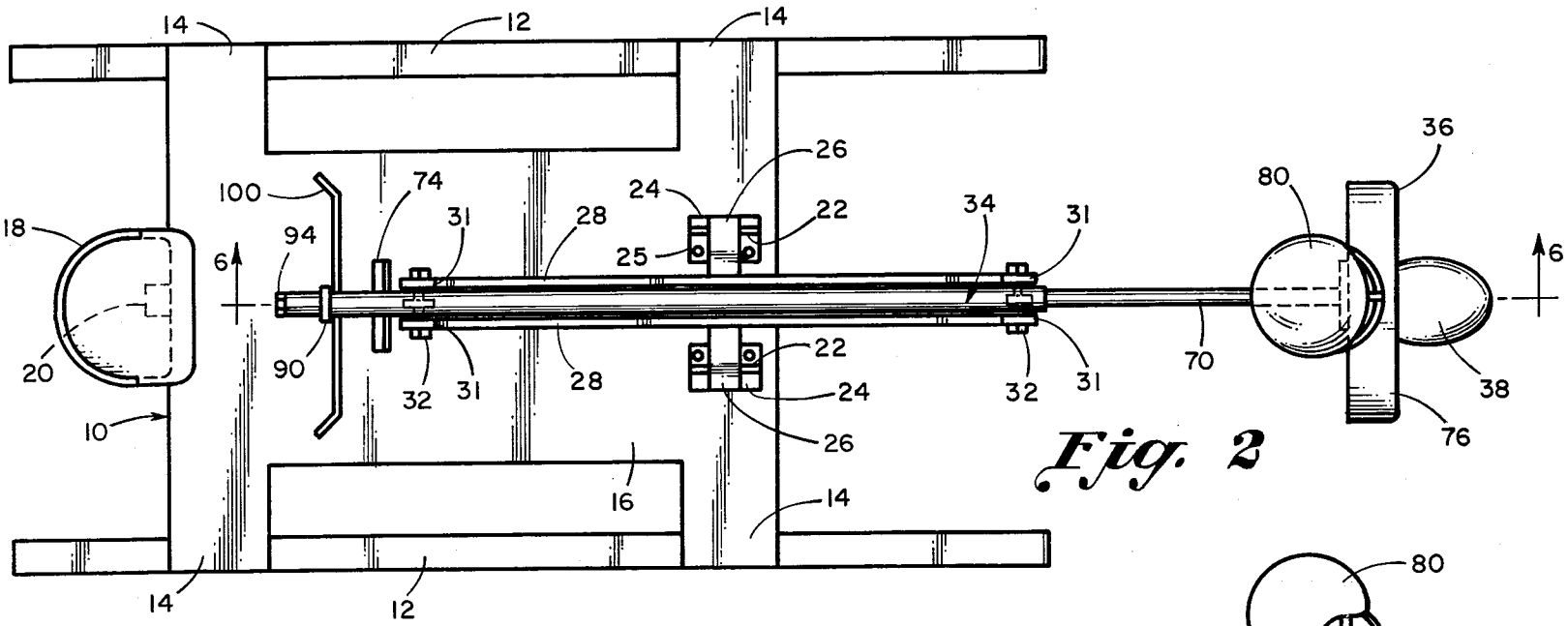
FIG. 2 is a top plan view of the blocking device shown in FIG. 1.
Figure 3:
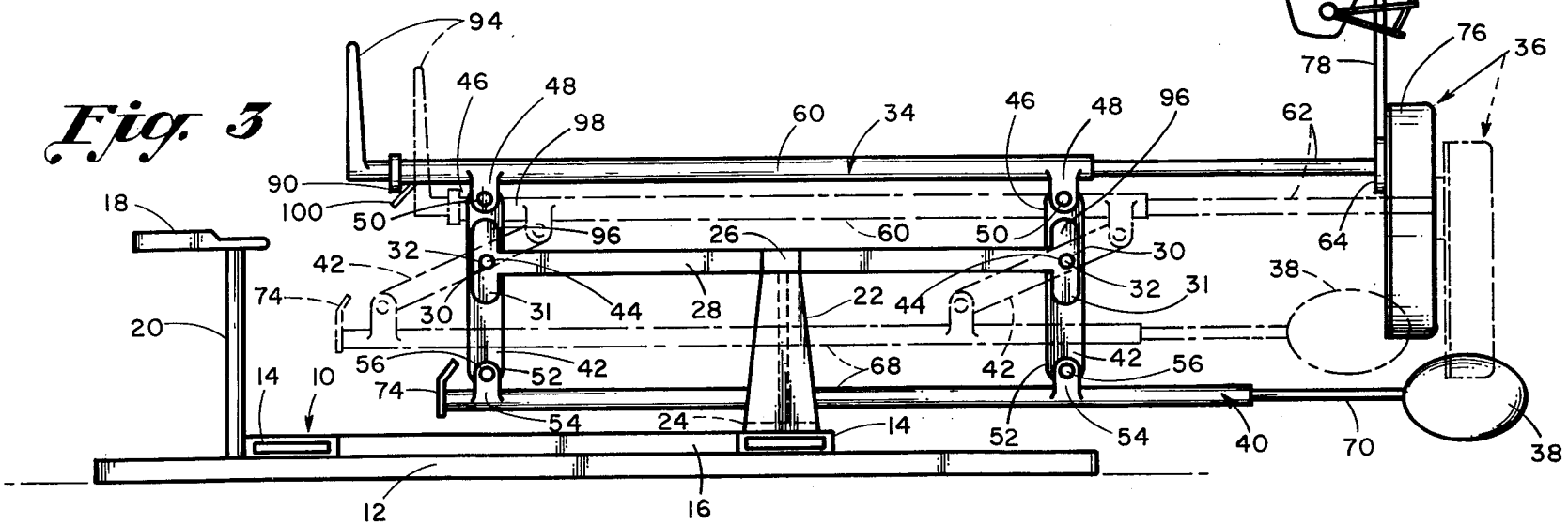
FIG. 3 is a side view of the blocking device shown in FIGS. 1 and 2 wherein the blocking dummy is shown in the set position in solid lines and is shown in the blocking position in phantom.

As shown in FIGS. 1, 3 and 3A, the elongate ram 34 extends in parallel relation to elongate rod 40, and, preferably the ram and rod extend in and are maintained in horizontal relation to platform 16 of base 10. Moreover, both lever members 42 extend in generally parallel relation to each other. As best shown in FIG. 3 and FIG. 3A, the ram 34, the rod 40 and lever members 42 form a parallelogram having four sides connected pivotally at all four junctions (pins 50 and 56) of the sides. The parallelogram pivots with respect to axes 44 on pins 32. It should be understood that this "parallelogram" movement provides a relatively simple and inexpensive mechanism for moving the blocking dummy 36 forwardly and downwardly while simultaneously moving the ball object rearwardly and upwardly. Referring in particular to FIG. 3 and FIG. 3A, the solid lines show the device in a set position and the dashed lines show the device after lever members 42 have been pivoted about pins 32 in the direction shown by the arrows in FIG. 3A.

Figures 4, 5, 6:
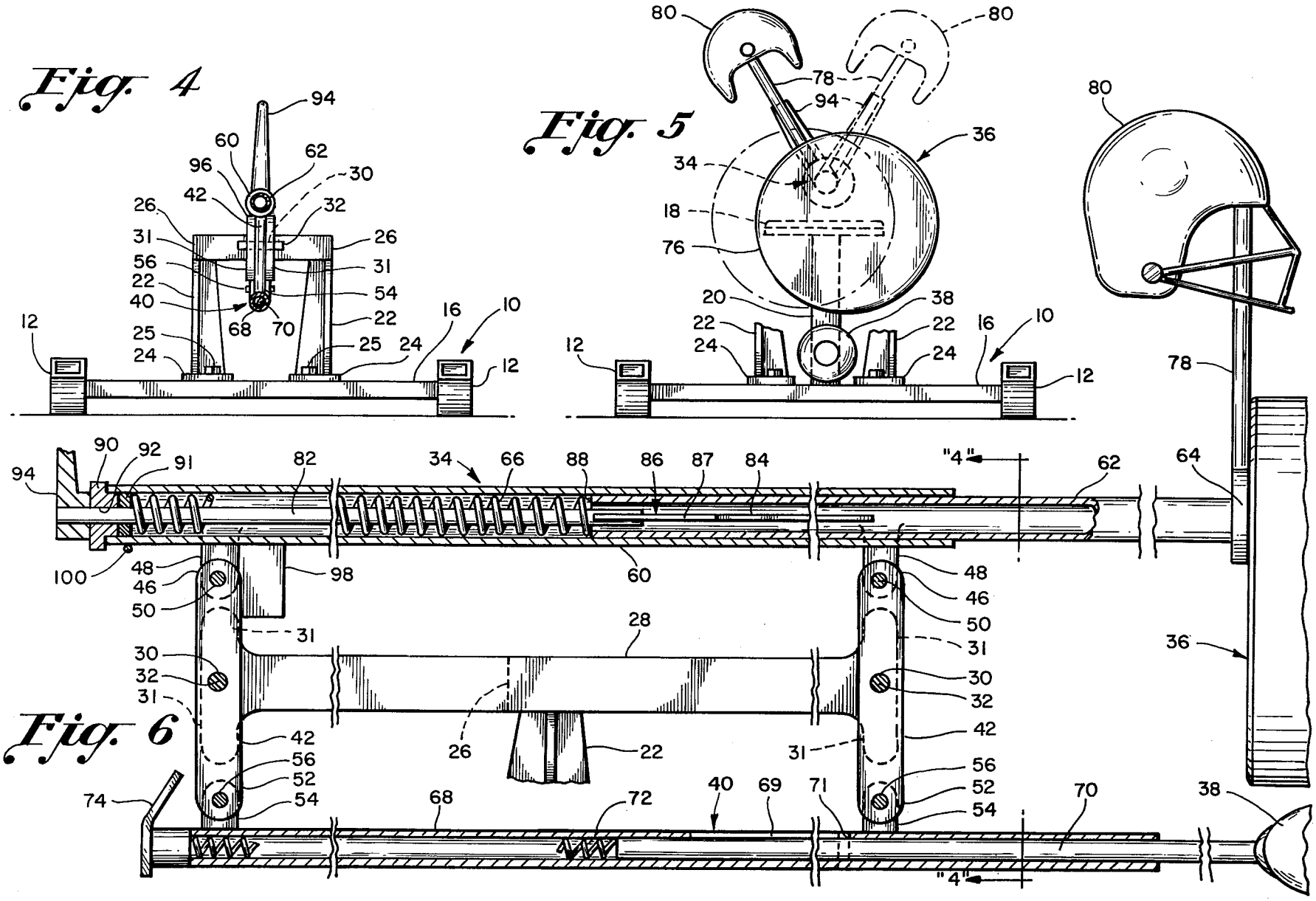
FIG. 4 is a sectional view along the plane 4—4 of FIG. 6 except that the blocking device is shown in the blocking position rather than in the set position and shows the support structure and the stop mechanism for limiting forward and downward movement of the ram.
FIG. 5 is a front view of the blocking device shown in FIGS. 1–4 and shows the blocking dummy turned in various positions to simulate a turning offensive lineman.
FIG. 6 is a sectional view along the plane 6—6 of FIG. 2 showing the details of the spring mechanism for biasing the blocking dummy forwardly and showing the mechanism for turning the blocking dummy.

In accordance with one aspect of the present invention, the blocking dummy is biased forwardly and is capable of being pushed rearwardly upon imposition of a rearward force against the blocking dummy by a defensive lineman contacting the blocking dummy. Referring in particular to FIG. 6, this biasing mechanism will now be described. Elongate ram 34 comprises a hollow tubular member 60 telescopically receiving a second tubular member 62 having the blocking dummy 36 mounted on the end thereof by end plate 64. Tubular member 62 is biased forwardly by a compression spring 66 disposed within hollow tubular member 60, the spring 66 urging tubular member 62 toward an extended position. Member 62 will therefore yield rearwardly against the spring 66 upon imposition of a force against the blocking dummy.

Also referring to FIG. 6, a similar biasing mechanism is used to allow yielding of the football object 38 when it is inadvertently contacted by a defensive lineman. More particularly, elongate rod 40 comprises a first tubular member 68 slidably receiving a second tubular member 70 that has said ball object 38 mounted on the end thereof. A compression spring 72 is disposed within hollow tubular member 68 and urges tubular member 70 toward an extended position. The second tubular member 70 having the ball object mounted thereon is moveable rearwardly against spring 72. The end of the elongate rod 40 opposite the end on which object 38 is mounted has a foot pedal 74 mounted thereon. Foot pedal, as will be described in detail hereinafter, assists the football coach in resetting the blocking device after a drill has been run.

In accordance with another aspect of the present invention, the football blocking device further includes a mechanism for rotating the blocking dummy 36 to simulate the turning of an offensive lineman. Referring in particular to FIGS. 4, 5 and 6, blocking dummy 36 includes a body portion 76 which is formed of any suitable shock absorbing material such as, for example, a foam pad covered with a vinyl material as is conventionally used in football blocking devices. Blocking dummy 36 further includes an elongate strut 78 extending upwardly from the top of the dummy and having a simulate head object 80 such as a football helmet mounted thereon. In order to train the defensive linemen not only to react to the charge of an offensive lineman, but also, to react to an offensive lineman who is turning as he charges, the device includes a mechanism for turning the dummy. The dummy is mounted eccentrically on the ram so that it tilts to one side as the helmet shifts to the opposite side.

Referring to FIG. 6, the mechanism for turning the dummy includes an elongate bar 82 disposed longitudinally within the hollow tubular member 60. The second tubular member 62 has at one end thereof a pair of diametrically opposed longitudinal slots 84 therein extending a portion of the length of tube 62. Slots 84 receive a generally rectangular plate 86 having two longitudinal edges 87 slidably engaging said diametrically opposed slots 84. The plate 86 is attached, preferably by welding, to inner end of bar 82. Bar 82 fits within the compression spring 66. The end 88 of of tube 62 abuts against sring 66. Elongate bar 82, which is preferably cylindrical, is journaled adjacent its outer end within end bearing 90 fitted at the rear end of the tube 60. Bearing 90 has an aperture 92 receiving bar 82 and allows rotation of bar by means of a crank lever 94 which is rigidly attached thereto. A retaining ring 91 is welded to bar 82 to prevent the bar from sliding toward the coach sitting directly behind the bar.

The operation of the football blocking device will now be described with reference to FIGS. 1–6, and, in particular FIGS. 3, 3A and 5. Pivotal lever members 42 are preferably in a vertical position at the beginning of a drill. The coach, sitting on seat 18, operates the blocking device by grasping crank lever 94. A defensive lineman lines up in front of blocking dummy 36 in a manner similar to that in game conditions. The coach, who may call audible signals in an effort to confuse the defensive linemen, at a desired time pushes the crank lever forward to pivot levers 42 about their respective pins 32. It should be understood that because the levers are in a generally vertical position at the outset, not much force is required on the part of a coach operating the device in that ram 34 and blocking dummy 36 tend to fall forwardly and downwardly under the force of gravity. This downward and forward movement occurs so rapidly as not to give the defensive linemen the chance to contact the blocking dummy 36 prior to the levers moving to the blocking position.

The forward and downward movement of the ram 34 is constrained by a stop mechanism that defines the blocking position of the ram. Referring to FIGS. 1, 3 and 4, the ends of support arms 28 have mallet-shaped ends 31 thereon having on their upper surfaces a stop surface 96 that contacts the ram 34 when the ram falls to the blocking position. As shown particularly well in FIG. 6, the ram 34 has a relatively large diameter so that it nests above and between the stop surfaces 96 on each of the mallet-shaped ends 31 or arms 28. It should be understood that this particular type of stop mechanism is shown by way of example only, and that other mechanisms for limiting the forward movement of ram 46 may be used.

Referring to FIGS. 3 and 3A, after the device has reached the blocking position shown in phantom in FIG. 3A, and the dummy is contacted by the charging lineman, the lever members, the ram and the rod are prevented from being pivoted under the force of the lineman in a reverse direction by a unique geometrical relationship between these components. Referring to FIG. 3A, the distance $d_1$ between the lever member pivot point 32 and the point 50 of pivotal connection between the upper end of lever member 42 and the ram 34 is relatively short. The angle of the lever member with respect to the vertical (shown in FIG. 3A by the arrows) is preferably greater than 45 degrees when the device is in the blocking position. Through the selection of distance $d_1$ and the angle of the lever member with respect to the vertical, the blocking device is designed so that the charging lineman's force, which may be quite large, is exerted on the lever members 42 at an angle and at a distance from lever point 32 such that a relatively small reverse moment is exerted on the lever member by the force of the charging lineman. If the angle of the lever between the vertical position and the blocking position is increased, the resistance of the lever members 42 to pivot in a reverse direction is increased. As shown particularly well in FIG. 3A, the blocking dummy 36 is mounted eccentrically downwardly with respect to ram 34 so that when the center area of the dummy is contacted by the charging lineman as shown by the arrow 51 in FIG. 3A, a downward moment about the point 50 is exerted on the ram 34 to urge it downwardly and to help maintain it in the blocking position when the dummy is contacted by the charging lineman. As shown in FIG. 3, the blocking dummy 36 in the blocking position is relatively near to the ground so it is extremely difficult for the advancing lineman to get under the dummy 36 and push it upwardly. Thus, the advancing lineman imposes a force as shown by arrow 51 in FIG. 3A on the blocking dummy that has a substantial rearward component but a very small or no upward component. Through a combination of the foregoing factors, for all practical purposes, the lineman will not be able to force the ram and the dummy upwardly and rearwardly.

As best illustrated in FIG. 3, the ball object 38 moves rearwardly and upwardly simultaneously with the forward and downward movement of blocking dummy 36 to simulate the snap of a football and a charging offensive lineman. If the coach desires to have the blocking dummy simulate a turning offensive lineman, the coach swings crank lever 94 either left or right to rotate the blocking dummy and helmet as is shown particularly well in FIG. 5. Thus, the defensive lineman must react to three variables: the snap of the ball object, the simulated charging of an offensive lineman and the simulated turning of an offensive lineman. Typically, before the defensive lineman can react to the movement of the blocking dummy and the snap of the ball object, the blocking dummy and ball object have reached the "blocking position" shown in phantom in FIG. 3.

With the blocking device in the "blocking position" shown in phantom in FIG. 3, contact by the defensive lineman driving it rearwardly against the bias of internal spring 66 which has been described in detail above. If the defensive lineman incidentally contacts ball object 38 it will be pushed rearwardly against the force of spring 72.

Once the blocking drill has been completed, the coach may reset the blocking device while remaining in the sitting position on seat 18. It should be understood that this is a particular advantage over many prior art blocking devices in that the coach can quickly reset the device for another drill. The resetting of the device is accomplished by pivoting the lever members 42 in a reverse direction to restore them to a vertical position or a position just past vertical. In order to facilitate resetting the unit by the coach, a foot pedal 74 affixed at the end of rod 40 nearest the coach's position to allow the coach to push downwardly and forwardly on foot pedal 74 with his foot to move the rod 40 thereby pivoting the lever members 42. As shown in FIG. 3A, the distance $d_2$ between pivot point 32 and pivot connection point 56 is relatively large to give the coach a large amount of leverage in resetting the device by using foot pedal 72. Preferably, the ratio of the distance $d_2$ to the distance $d_1$ is between about 1.5 to about 2.5. The device may optionally include a handle bar 100 welded to the underside of member 60 for hand resetting of the device by the coach.

Abutment 98 welded to the underside of ram 34 contacts rear lever 42 to prevent further rearward movement of the rear lever 42 once it has reached a vertical position or a position just slightly rearward of a vertical position. The football blocking device is now restored to the set position and is ready for another drill.

The concept of the blocking device shown in FIGS. 1–6 can be expanded to provide simulation of more than one charging offensive lineman. More particularly, referring to FIGS. 7–9, another embodiment of the invention is shown wherein the blocking device includes three blocking dummies. To the extent possible, the device shown in FIGS. 7–9 has components numbered with the same reference characters as corresponding components shown in FIGS. 1–6, except that suffixes a, b and c will be added where the components are the same for each of the three blocking dummies.

The device includes two central support posts 102 and 104 having respectively feet 106 and 108 attached to support base 10 by bolts or welding. Rigidly mounted on the top of support post 102 and 104 is a cylindrical tubular supporting arm 110 for pivotally supporting lever members 118 and 119, corresponding in function to levers 42 of the single blocking dummy unit shown in FIGS. 1–6. Each end of supporting arm 110 includes a longitudinal slot 112 therein. A pair of spaced apart plates 113 are welded to arm 110 and form a slot therebetween in which levers 118 and 119 are pivotally mounted. Transverse pivot pins 114 and 116 extend between each pair of plates 113 and have levers 118 and 119 pivotally mounted thereon.

Figures 7, 7A:
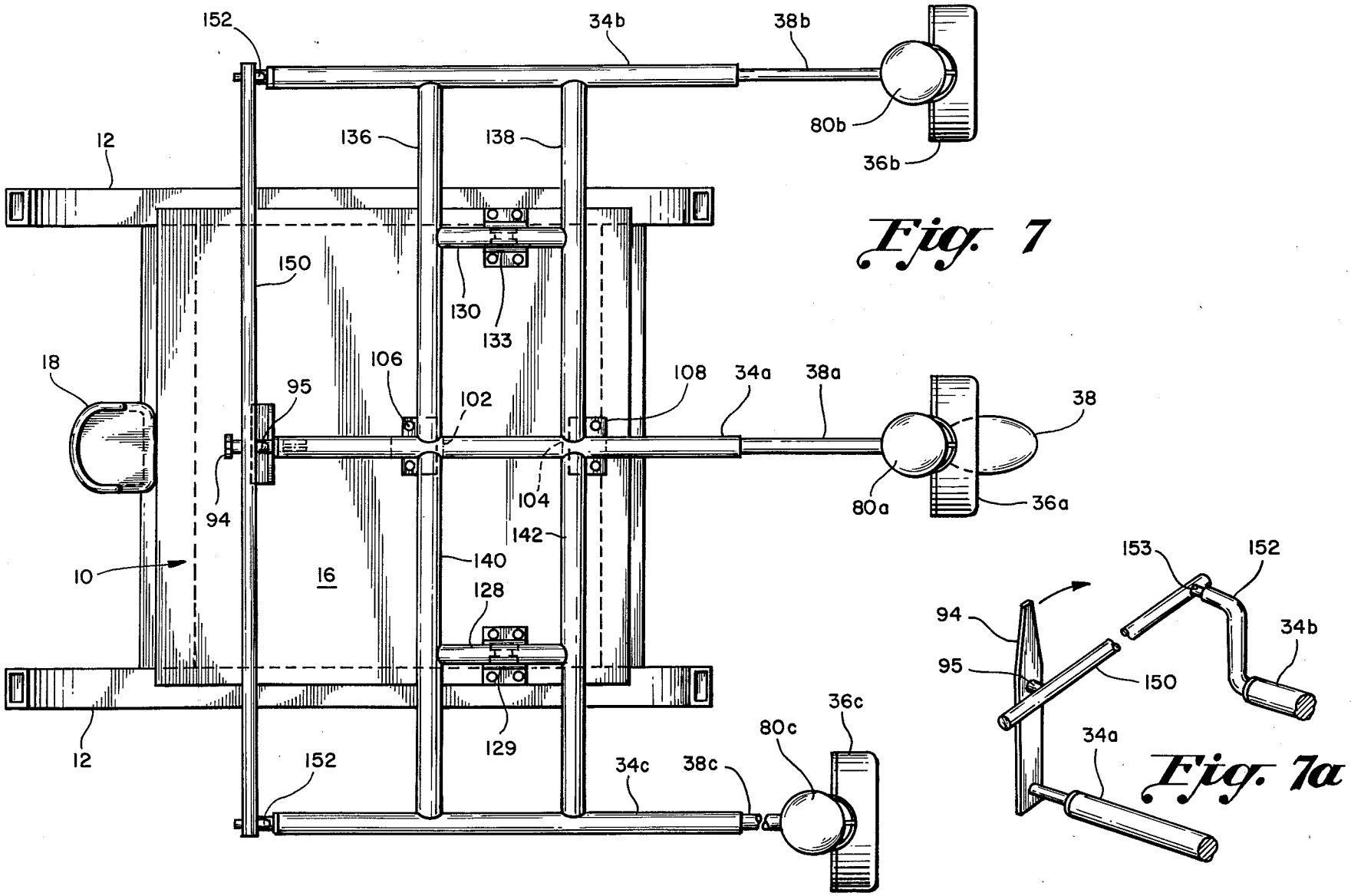
FIG. 7 is a top plan view of another embodiment of a football blocking device in accordance with the present invention wherein the blocking device includes three blocking dummies.
FIG. 7A is an enlarged perspective view of the linkage that simultaneously turns three blocking dummies.
Figure 8:
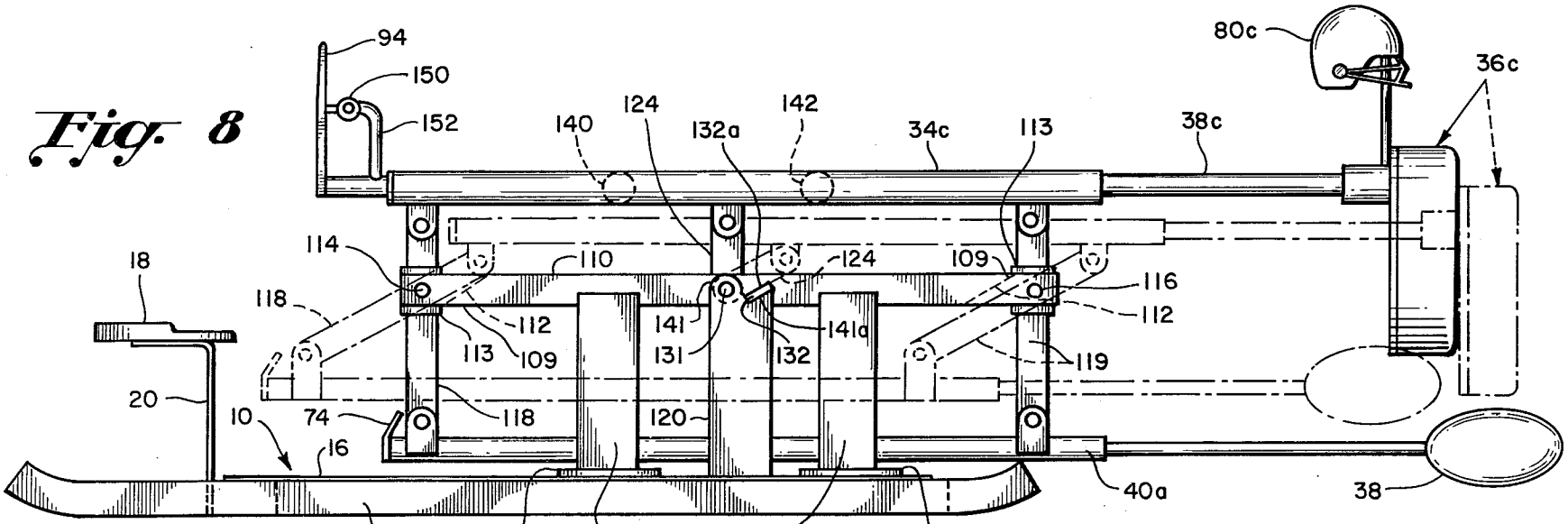
FIG. 8 is a side view of the football blocking device shown in FIG. 7 wherein the set position of the blocking device is shown in solid lines and wherein the blocking position is shown in phantom.
Figure 9:
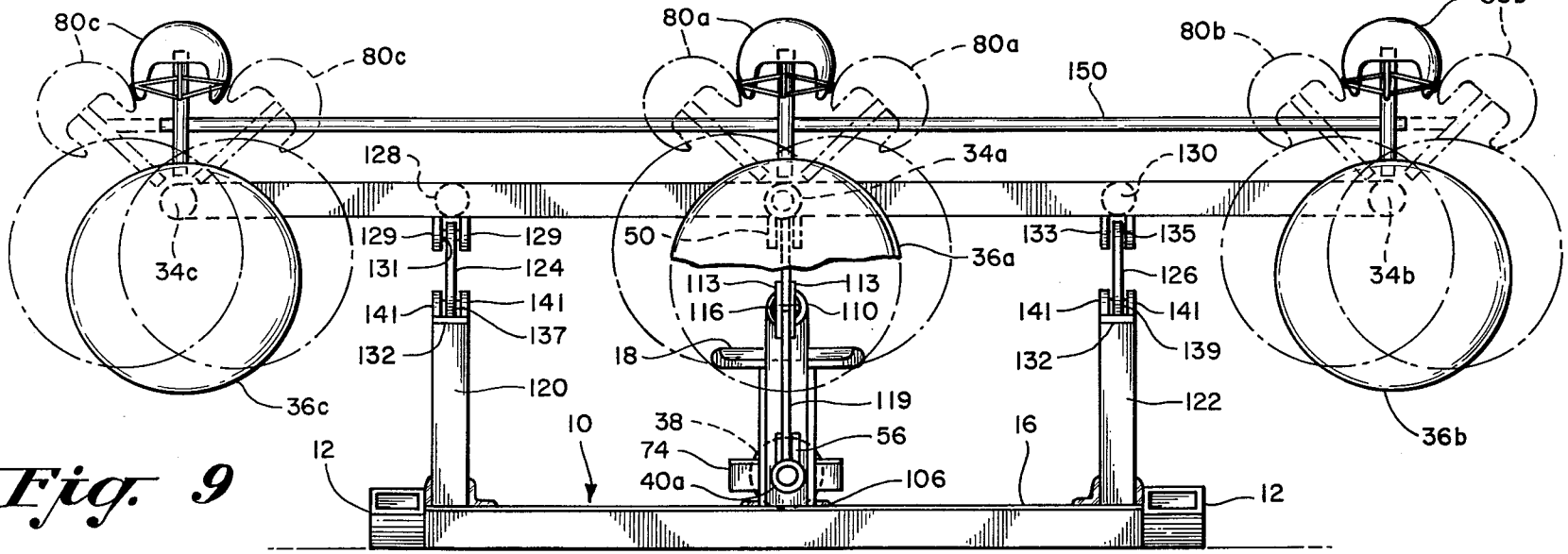
FIG. 9 shows a front view of the football blocking device shown in FIGS. 7 and 8 wherein the central blocking dummy is broken away to expose the support structure, and wherein the blocking dummies are turned to various positions and are shown in phantom to simulate turning offensive linemen.

Referring in particular to FIG. 7, the three elongate rams 34*a*, 34*b* and 34*c* are rigidly connected to one another by transverse tubular struts 136, 138, 140 and 142 which are welded on the ends thereof to the elongate rams. Extending between struts 136 and 138 is a supporting strut 130, and extending between struts 140 and 142 is a similar supporting strut 128. Thus, the three elongate rams, 38*a*, 38*b* and 38*c* are rigidly connected to one another so that they move forwardly and downwardly simultaneously. In order to support the outer most rams, that is, rams 34*b* and 34*c*, support base includes two outer support posts 120 and 122 (shown in FIGS. 8 and 9) for each tubular support member 128 and 130. To allow for forward and downward movement of the three elongate rams, tubular supports 128 and 130 are attached to supports 120 and 122 via levers 124 and 126. Tubular support 128 has welded to the underside thereof two spaced apart plates 129 having a pin 131 extending therebetween. One end of lever 124 is pivotally mounted on pin 121. Similarly, tubular support 130 has two spaced apart plates 133 welded thereto. A pin 135 extends between the plates 133 and has the end of lever 126 pivotally mounted thereon. As can be seen in FIGS. 8 and 9, the lower ends of levers 124 and 126 are pivotally mounted on pins 137 and 139. These pins are mounted between spaced apart pin retaining walls 141 on the upper ends of support posts 120 and 122.

As best shown in FIGS. 8 and 9, the stop mechanism for limiting forward movement of the three rams is incorporated into outer posts 120 and 122. Retaining walls 141 are shaped to provide inclined surfaces 141*a* (see FIG. 8) that have a plate 132 welded thereto. Plate 132 spans the gap between inclined surfaces 141*a* and has an upper surface 132*a* that contacts the bottom edge of lever 124 where the lever moves to the blocking position as shown in phantom in FIG. 8. It should be understood that a similar stop mechanism is incorporated in support post 122 to symetrically distribute the impact force when the levers 124 and 126 contact their respective stop mechanisms. In order to prevent the levers 118 and 119 from collapsing rearwardly beyond the vertical position when the blocking device is restored to the set position, the longitudinal slot in both ends of the arm 110 is sized so that the tubular wall at reference character 109 (see FIG. 8) is contacted by the levers.

As shown in FIGS. 8 and 9 pivotal support levers 124 and 126 and support posts 120 and 122 provide for balanced distribution of forces. If the outer blocking dummies 36*b* and 36*c* are contacted by linemen imposing greatly different forces, the levers 124 and 126 resist torque on levers 116 and 118 and the resultant deformation of the device that otherwise might have occured. Moreover, when the device is either in the set position or the blocking position and a person leans on one of the outer rams 34*b* or 34*c*, support levers 124 and 126 prevent the entire upper structure of the device (including struts 136, 138, 140 and 142 and the rams 34*a*, 34*b* and 34*c*) from tipping to one side or from being inadvertantly actuated.

The internal structure of rams 34*a*, 34*b* and 34*c* is the same as internal structure described with respect to the single dummy blocking device described in FIG. 6. It should be understood that although all three blocking dummies advance forwardly and downwardly simultaneously, the three defensive linemen that react can contact the blocking dummies at different times and with different forces. More specifically, each compression spring contained within its respective elongate ram functions independently to absorb the impact of the respective defensive linemen contacting the blocking dummy.

In accordance with another aspect of the present invention, the blocking device may include a linkage to turn all three blocking dummies at the same time to simulate three offensive linemen turning in the same direction.

Referring to FIGS. 7–9, and in particular FIG. 7A, the linkage for turning all three blocking dummies will be described in detail. Crank lever 94 is rotatably connected to a swivel bar 150 which extends the distance between rams 34*b* and 34*c*. As shown in FIG. 7A, ram 34*b* (and likewise ram 34*c* not shown in FIG. 7A) includes a shortened crank lever 152 which is pivotally connected to swivel bar 150 by pin 153. Likewise, crank lever 94 includes a pin 95 pivotally mounted with respect to swivel bar 150. When the crank lever is turned by the coach to his left as shown by the arrow in FIG. 7*a*, swivel bar 150 moves downwardly and to the left to turn shortened crank lever 152 in the direction shown by the arrow in FIG. 7A.

It should be understood that if it is desirable to have the blocking dummies turn in different directions, rod 150 can be eliminated and several coaches can independently actuate the turning of blocking dummies through their own respective crank lever.

Football blocking devices in accordance with the present invention, have the particularly important advantage that they are relatively safe to use. More particularly, when the elongate ram, or rams as the case may be, fall forwardly and downwardly under their own weight, the rams move to the blocking position before the defensive lineman has had an opportunity to react and contact the blocking dummy. Furthermore, even if the defensive lineman is contacted by the blocking dummy before it reaches its blocking position, the blocking dummies yield against the force of the compression spring contained therein to provide a shock absorbing effect thereby alleviating risk of injury. Safety is further provided by a football which retracts rearwardly and upwardly to a position behind the blocking dummy (see phantom line positions of FIG. 3) where it is no longer in the general area of contact by the defensive lineman. Should the defensive lineman contact the football object while it is being moved rearwardly and upwardly, the football 38 can yield rearwardly against its own uncompressed spring. Furthermore, once the ball object is moved rearwardly and upwardly to a position behind the blocking dummy it is in a position to reinforce the spring for the blocking dummy. Thus, when the blocking dummy moves to the rear sufficiently to contact the ball object, and force the ball object rearwardly, the force resisting the defensive lineman is almost doubled by the joint effect of the springs in the elongate ram and in the elongate rod.

It should be understood that the design of the football blocking device of the present invention is particularly simple in that, in the preferred form, it uses the concept of two pivoting levers which form a parallelogram with the elongate ram and the elongate rod. This provides a particularly simple and safe football blocking device. Moreover, the particular geometric relationships between the components that form the parallelogram enable the device to be maintained in the blocking position when the blocking dummies, or dummy as the case may be, are contacted by the charging lineman yet allow the device to be reset with a small effort by the coach.

It should be understood that although a specific embodiment of the invention has been described herein in detail, such description is for purposes of illustration only and modifications may be made thereto by those skilled in the art within the scope of the invention.

What is claimed is:

1. A football blocking device for training defensive linemen to react to the snap of a football and to a charging offensive lineman, the device comprising:

at least one blocking dummy;

an elongate ram having said blocking dummy mounted on an end portion thereof;

a ball object positioned adjacent said blocking dummy; and means for supporting said elongate ram and said ball object including pivot means pivotally operable on said elongate ram and said ball object for simultaneously moving said ball object rearwardly to simulate the snap of the football and said blocking dummy forwardly and downwardly from a set position to a blocking position while maintaining said ram in a generally horizontal position with respect to said supporting means to simulate a charging offensive lineman.

2. A football blocking device according to claim 1, said ball object being mounted on an end portion of an elongate rod, said support means including a supporting base and at least one lever member pivotable on said supporting base about an axis fixed relative thereto, said one lever member having an upper end connected pivotally with said ram and having a lower end connected pivotally with said rod to provide for movement of said blocking dummy from said set position to said blocking position with simultaneous rearward movement of said ball object upon pivoting of said lever member in one direction.

3. A football blocking device according to claim 2, said support means including a second lever member pivotable on said base about another axis fixed relative thereto and spaced from, and parallel to, said one axis, said second lever member having an upper end connected pivotally with said ram and having a lower end connected pivotally with said rod.

4. A football blocking device according to claim 3, wherein said elongate ram extends in parallel relation to said elongate rod and wherein said elongate rod, said elongate ram, and said first and second lever members form a parallelogram having four sides connected pivotally at the junctions of the sides.

5. A football blocking device according to claim 4, wherein said elongate ram and said elongate rod are maintained in generally horizontal relation during pivoting of said lever members about their respective axes.

6. A football blocking device according to claims 1 or 5 wherein said blocking dummy includes a simulated head object located at an upper region thereof, and further including means for rotating said blocking dummy about the longitudinal axis of said elongate ram in order to simulate turning of an offensive lineman.

7. A football blocking device according to claims 1 or 5 and further including means biasing said blocking dummy forwardly, said blocking dummy being depressable rearwardly against said biasing means upon imposition of a rearward force against said blocking dummy.

8. A football blocking device according to claim 7, wherein said elongate ram comprises a hollow tubular member slidably receiving a second tubular member having said blocking dummy mounted on the end thereof, said biasing means comprising spring means disposed within said hollow tubular member urging said second tubular member toward an extended position such that said second tubular member slides rearwardly in relation to said first tubular member against said spring means upon imposition of said force.

9. A football blocking device according to claim 8, wherein said blocking dummy includes a simulated head object located at the upper region thereof, and further having means for rotating said dummy about the longitudinal axis in order to simulate turning of an offensive lineman, said rotating means including an elongate bar disposed longitudinally within said first-mentioned tubular member, said second tubular member being hollow and having at one end thereof means for engaging said elongate bar for rotation of said second tubular member upon rotation of said bar, said second tubular member being slidable longitudinally with respect to said bar upon retraction of said second tubular member, said bar extending outwardly of said first tubular member and terminating in a crank lever for manually rotating said bar.

10. A football blocking device according to claim 9, wherein said means for engaging comprises a pair of diametrically opposed longitudinal slots along one end of said second tubular member, a plate having opposite sides slidably engaging said slot and being attached at one end of said bar to provide for rotation of said second tubular member in response to rotation of said bar while permitting said second tubular member to slide longitudinally on said bar upon retraction thereof.

11. A football blocking device according to claim 2 or 5, wherein said rod on which said ball object is mounted comprises a hollow tubular member slidably receiving a second tubular member, said ball object being mounted on the end of said second tubular member, said rod further including spring means biasing said second tubular member forwardly, said second tubular member being depressable rearwardly against said spring means upon imposition of a rearward force on said ball object.

12. A football blocking device according to claim 1 or claim 5, wherein said device further includes second and third elongate rams each having a blocking dummy mounted on the end portion thereof, said second and third rams being located on opposite sides of said first ram, and further including a support lever member for each of said second and third rams having one end pivotally connected to its respective ram and having another end pivotable on said supporting base about an axis fixed relative thereto, said support lever members being located on opposite sides of and spaced away from said first ram to provide for balancing of forces imposed on said first, second and third rams, said elongate rams extending parallel to each other, being rigidly connected to each other and moveable together from said set position forwardly and downwardly to said blocking position to simulate three charging offensive linemen.

13. A football blocking device for training defensive linemen to react to the snap of a football and to charging offensive linemen, the device comprising:

a supporting base;

at least one blocking dummy mounted on an end portion of an elongate ram;

a ball object positioned adjacent said blocking dummy and mounted on an end portion of an elongate rod;

a first lever member having an upper end and a lower end and being pivotally mounted intermediate its ends on said base about an axis fixed relative thereto, said upper end connected pivotally with said ram and said lower end connected pivotally with said rod;

means for pivoting said lever member forwardly to move said ball object rearwardly and upwardly and to simultaneously move said blocking dummy from a set position forwardly and downwardly to a blocking position to thereby simulate the snap of a football and the charge of an offensive lineman; and means for biasing said elongate ram forwardly, said elongate ram being depressable rearwardly against said biasing means without rearward pivoting of said lever member upon imposition of a rearward force against said blocking dummy.

14. A football blocking device according to claim 13, and further including a second lever member having an upper end and a lower end and being pivotal about another axis fixed relative to said base and spaced from, and parallel to, said first-mentioned axis, the upper and lower ends of said second lever member being pivotally connected respectively with said elongate ram and said elongate rod.

15. A football blocking device according to claim 13, wherein said elongate ram and said elongate rod are disposed in parallel relation to one another and are maintained in a horizontal position as said lever members are pivoted.

16. A football blocking device according to claim 15, wherein said lever members are positioned generally vertically at said set position of said blocking dummy and are pivotable to said blocking position through an angle of at least 45°.

17. A football blocking device according to claim 16, and further including stop means for limiting the pivotal movement of at least one of said levers beyond said blocking position.

18. A football blocking device according to claim 17, and further including handle means located on an end of the ram opposite that to which said dummy is mounted to provide for manual movement of the ram downwardly and forwardly.

19. A blocking device according to claim 18, wherein said elongate rod at an end opposite the end to which said ball object is mounted includes a foot pedal to provide for exertion of a forward force on said rod to return said ball object to its normal position and to move said blocking dummy from said blocking position to said set position.

20. A football blocking device according to claims 13 or 18 and further including means for rotating said elongate ram to thereby rotate said blocking dummy to simulate a turning offensive lineman.

21. A football blocking device for training linemen to react to an opposing lineman who is charging, the device comprising:

a supporting base;

at least one elongate ram having a blocking dummy mounted on an end thereof;

first and second lever members each having an upper end connected pivotally with said ram and having another portion pivotally mounted on said base about an axis fixed relative thereto; and means for pivoting said lever members forwardly to move said blocking dummy from a set position forwardly and downwardly to a blocking position to simulate the charge of an opposing lineman.

22. A football blocking device according to claim 21 and further including means for biasing said elongate ram fowardly, said elongate ram being depressable rearwardly against said biasing means without rearward pivoting of said lever members upon imposition of a rearward force against said blocking dummy.

23. A football blocking device according to claim 21 wherein each of said levers includes a lower end, and further including a ball object positioned adjacent said blocking dummy and mounted on an end portion of an elongate rod, said lower end of each of said levers being connected pivotally with said rod, said means for pivoting said lever member moving said ball object rearwardly and upwardly and simultaneously moving said blocking dummy from said set position to said blocking position to thereby simulate the snap of a football and the charge of an offensive lineman.

* * * * *